US006190198B1

(12) United States Patent
Ray

(10) Patent No.: US 6,190,198 B1
(45) **Date of Patent: *Feb. 20, 2001**

(54) ELECTRICAL FITTINGS FOR SUSPENDED CEILINGS

(76) Inventor: Peter Ray, Seagull Cottage, Runswick Bay, North Yorkshire TS13 5HT (GB)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/142,960

(22) PCT Filed: Mar. 21, 1997

(86) PCT No.: PCT/GB97/00794

§ 371 Date: Nov. 14, 1998

§ 102(e) Date: Nov. 14, 1998

(87) PCT Pub. No.: WO97/35146

PCT Pub. Date: Sep. 25, 1997

(30) Foreign Application Priority Data

Mar. 21, 1996 (GB) ..... 9605920
Oct. 4, 1996 (GB) ..... 9620746

(51) Int. Cl.[7] ..... H01R 13/60
(52) U.S. Cl. ..... 439/532
(58) Field of Search ..... 439/532, 529, 439/575; 174/135; 248/317; 362/150, 396

(56) References Cited

U.S. PATENT DOCUMENTS

| | | |
|---|---|---|
| 3,589,660 | 6/1971 | Dunckel . |
| 3,952,985 | 4/1976 | Davenport . |
| 4,135,692 | 1/1979 | Ferguson . |
| 4,191,352 | 3/1980 | Schuplin . |
| 4,605,818 | 8/1986 | Arroyo et al. . |
| 4,924,037 | 5/1990 | Ainsworth et al. . |

*Primary Examiner*—Gary P. Paumen
(74) *Attorney, Agent, or Firm*—John L. Lee

(57) ABSTRACT

An electrical appliance such as a lamp (1) includes attachment means adapted for mounting on a member (50) of the grid of a suspended ceiling. The attachment is in the form of a clip (5) which, in common with the preferably PTFE-coated wires (11) of the lamp, is thin enough to pass between the flange (52) of the ceiling member and the ceiling panels. This avoids having to drill into the ceiling grid and allows flexibility in the positioning of the lamp.

26 Claims, 4 Drawing Sheets

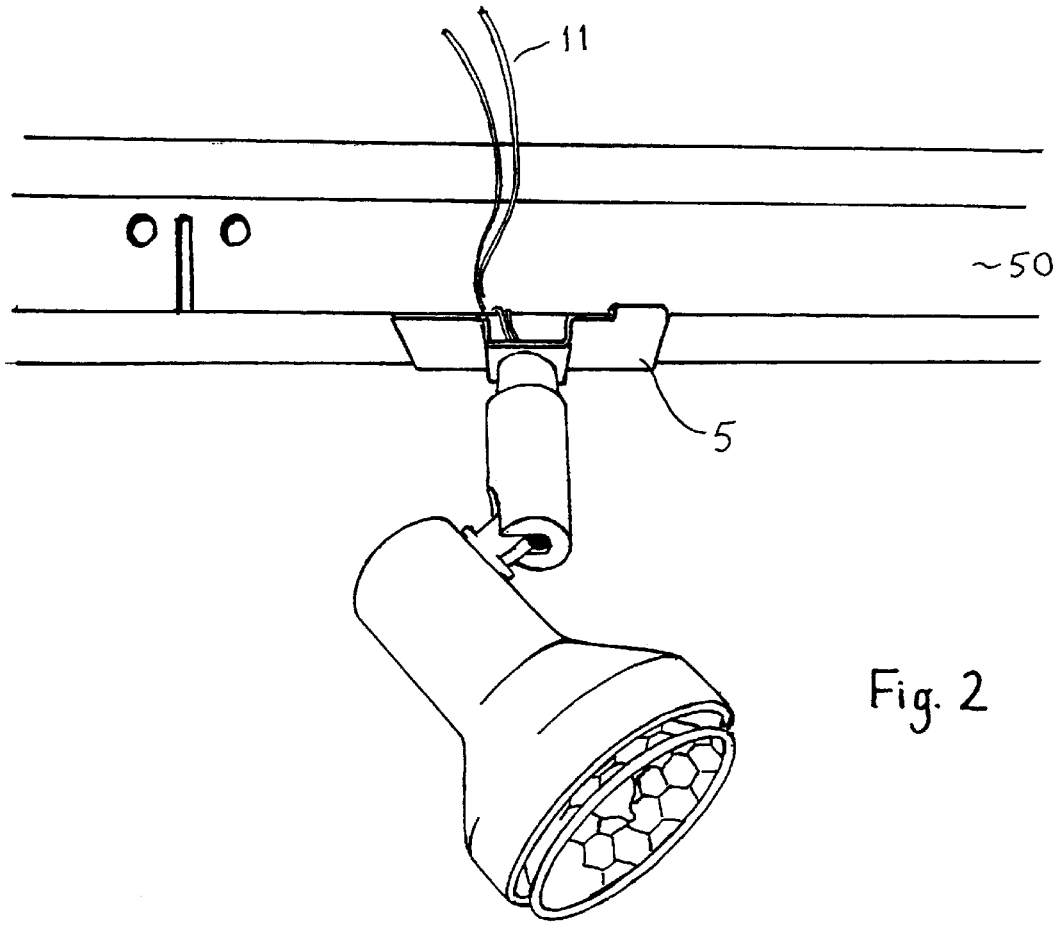
Fig. 2
Fig. 3
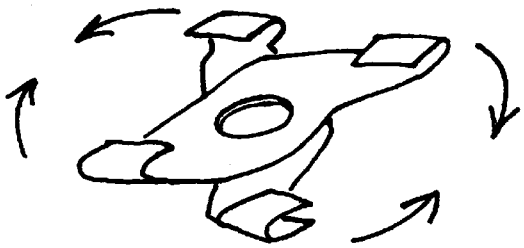
Fig. 4
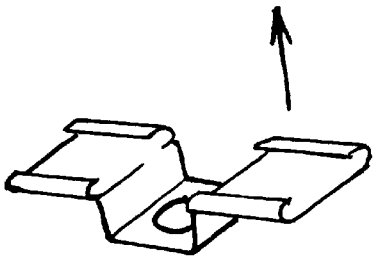

SPOTLIGHT

ELECTRICAL FITTINGS FOR SUSPENDED CEILINGS

TECHNICAL FIELD

The invention relates to electrical fittings in suspended ceilings, and is particularly applicable to light fittings such as spotlights.

BACKGROUND

Conventionally, suspended ceilings comprise a grid of intersecting members in the form of metal tracks, called "main tees", suspended below a ceiling. The metal tracks have horizontal flanges at their lower ends which are used to support ceiling panels. The cavity formed above the ceiling panel is used to pass electrical service wires to which light fittings of various sorts may be connected. Fluorescent light tubes may typically be attached to fittings placed on the grid tracks, which are approximately the size of the spacing and thus will replace a panel in that spacing.

However, when bulb lights such as halogen lights are used the fittings are smaller and thus entire panels are not removed. Instead modified panels are used and the lamp fitting is either mounted directly on the panel, or else a subsidiary track is fastened to the ceiling underneath the panel, the panel having a hole for the wires to connect to the lights.

Some expense is therefore involved when mounting lamps on existing ceilings because ceiling panels have to be replaced with modified panels. Even when the fittings are placed below the ceiling panels the panels still have to be modified to pass the electrical cables from the ceiling cavity. Halogen lamps have relatively high power requirements and consequently require relatively large wires whose appearance below the ceiling panels would generally be considered unsightly.

The present invention in some embodiments therefore aims to provide electrical fittings such as halogen lamps that can be attached to an existing ceiling arrangement of the type described without requiring modification or replacement of existing ceiling panels or like components.

SUMMARY

In accordance with a first aspect of the invention there is provided an electrical or other appliance for use with a suspended ceiling, wherein the appliance includes attachment means adapted for mounting on a member of the suspended ceiling grid.

The attachment means should be adapted for manually releasable fixing to the grid and can advantageously be in the form of a clip engaging one or both sides of the grid rail. A preferred form of such a clip is one having two U-shaped fastening members respectively corresponding to the opposite sides of the rail, of a configuration such that they can be clipped to the rail by a simple rotary or twisting action about the vertical axis. The fastening members, and indeed the entire clip, could be made of sheet material, of a thickness sufficiently small so as not to disturb the positioning of a ceiling panel on the grid.

The electrical apparatus, which can be a ceiling spotlight, will generally have wiring for connecting to an electrical supply above the ceiling; preferably the wiring is coated with an insulator of a heat-resistant substance such as PTFE, and like the clip itself is sufficiently thin to pass through the ceiling, around the grid members, without disturbing the panels.

According to a second aspect of the invention there is provided a suspended ceiling grid comprising a plurality of tracks arranged to form the grid and at least one electrical fitting releasably attached to a track. The attachment is by means such as a clip that allows displacement along the track so that the fitting can be placed at an arbitrary location on the track and subsequently moved if desired without any residual damage to the track.

According to a third aspect of the invention there is provided a suspended ceiling assembly including a grid and panels arranged in the grid, further including an electrical appliance fitted below the panels having wiring passing between the panels and the grid into the space above the panels. Such a ceiling assembly, in which the wiring will have a diameter not greatly exceeding 1 mm, avoids the necessity of making holes in or otherwise damaging the grid and the panels. This is particularly significant for devices such as halogen spots which are small; fluorescent tube fittings are large enough to cover any hole made through the panel for passing the wires through.

According to a fourth aspect of the invention there is provided a method of mounting a lamp fitting on a suspended ceiling of the kind having ceiling panels fitted in the spaces defined by the tracks of a grid, comprising the steps of: attaching the lamp fitting to the underside of a track of the grid, and running a wire from the fitting towards a power supply above the ceiling through a gap between the track and the ceiling panel resting on the track in such a way that the ceiling panel is not substantially displaced by the wire.

According to a fifth aspect of the invention there is provided a method for attaching an electrical apparatus to a suspended ceiling in which the apparatus is clipped to a flange of the grid of the ceiling.

PTFE is a substance that can be used as electrical insulation for wiring. It has the advantage that it is mechanically robust and is more resistant to heat than substances conventionally used for wiring insulation, such as PVC and silicone. As a result, the use of PTFE permits thinner wiring to be made for the same rating. Consequently the electrical fitting, which may be for example a halogen lamp fitting, can now be suspended from the main tracks of the ceiling grid and connected to the cable supply running within the ceiling duct using thin unobtrusive wires which can be run in the gap between the ceiling grid and associated ceiling panel without substantially displacing the ceiling panel or requiring any form of hole to be cut in the ceiling panel. Thus, lamp fittings according to embodiments of the invention may be applied to existing ceilings without further modification to any component of the ceiling.

The invention has been particularly conceived for low-voltage apparatus, i.e. apparatus using voltages such as 12 V which are not considered to present a health hazard, since the bending of the wire around the grid track is not likely to contravene any regulations. However, in principle the fitting could be used for mains appliances.

The tracks of a suspended ceiling grid are generally T-shaped with the bar of the T at the lower end of the track to support the ceiling panels. Thus the attachment means may suitably comprise a clip having projections which grasp the T-bar projections on one or both sides. Such a clip may be slidable along the T-bar, which assists in placing or moving the lamp, and, in embodiments where the clip engages both sides of the bar, the engaging portions on either side may be offset from one another along the length of the track to facilitate insertion and removal of the clip, in that the clip can be applied in a skew orientation and then rotated into line with the track, the clip engaging the flanges of the track. Numerous other forms of clip suitable for attachment to projecting flanges can be used and only a small selection is given in the attached drawings.

In one modification the electrical wiring for the appliance is in the form of a connector having preferably flat conductors adapted to be placed on the upper part of the grid, in combination with conductors associated with the attachment means of the appliance and adapted to make contact with the exposed conductors on the grid when the appliance is mounted on the grid member.

Preferably the conductors on the attachment means are integral with it, in particular by being moulded in to the attachment means. Most conveniently the attachment means is made of an insulating material such as plastics and the conductors are embedded in the plastics material. These conductors can then have ends protruding from the plastics in order to make contact with the exposed conductors on the grid.

The conductors in question can be linear or wire-shaped, but this makes it difficult to match the exposed ends when fitting the appliance to the grid. Preferably therefore at least one of the sets of conductors has a certain lateral extent, i.e. along the grid member, so that there is a leeway of, say, about a centimeter when placing the appliance. The appliance conductors can themselves be strip-shaped so as to fit naturally inside the engaging bracket of the attachment means. The attachment means, as shown in the earlier application, will generally have wide hook-shaped fastening portions engaging over the lower bar of the grid member, and the appliance conductors can protrude out of the ends of these towards the central web of the T-section grid member. The upper conductors can then simply be flat conducting sheets, insulated on the rear side to prevent electrical contact with the web of the grid, themselves connected to wires leading to the transformer or other power supply.

The upper conductors can be in the form of a clip so that they stay in place on the grid, or a separate clip can be supplied to ensure that they do not slide about. Preferably one conductor is placed in each side of the grid member, though it would theoretically be possible to place them both on the same side, particularly if more than two conductors are involved. For a better understanding of the invention and to demonstrate how it may be put into practice embodiments of it will now be described with reference to the accompanying drawings.

BRIEF DESCRIPTION OF THE DRAWINGS

FIG. 2 is a view of the lamp mounted on a ceiling stay, FIG. 6 being a similar view showing a connector;

FIGS. 3, 4 and 5 are diagrams of alternative fixing arrangements.

DETAILED DESCRIPTION OF THE INVENTION

Figure 1:
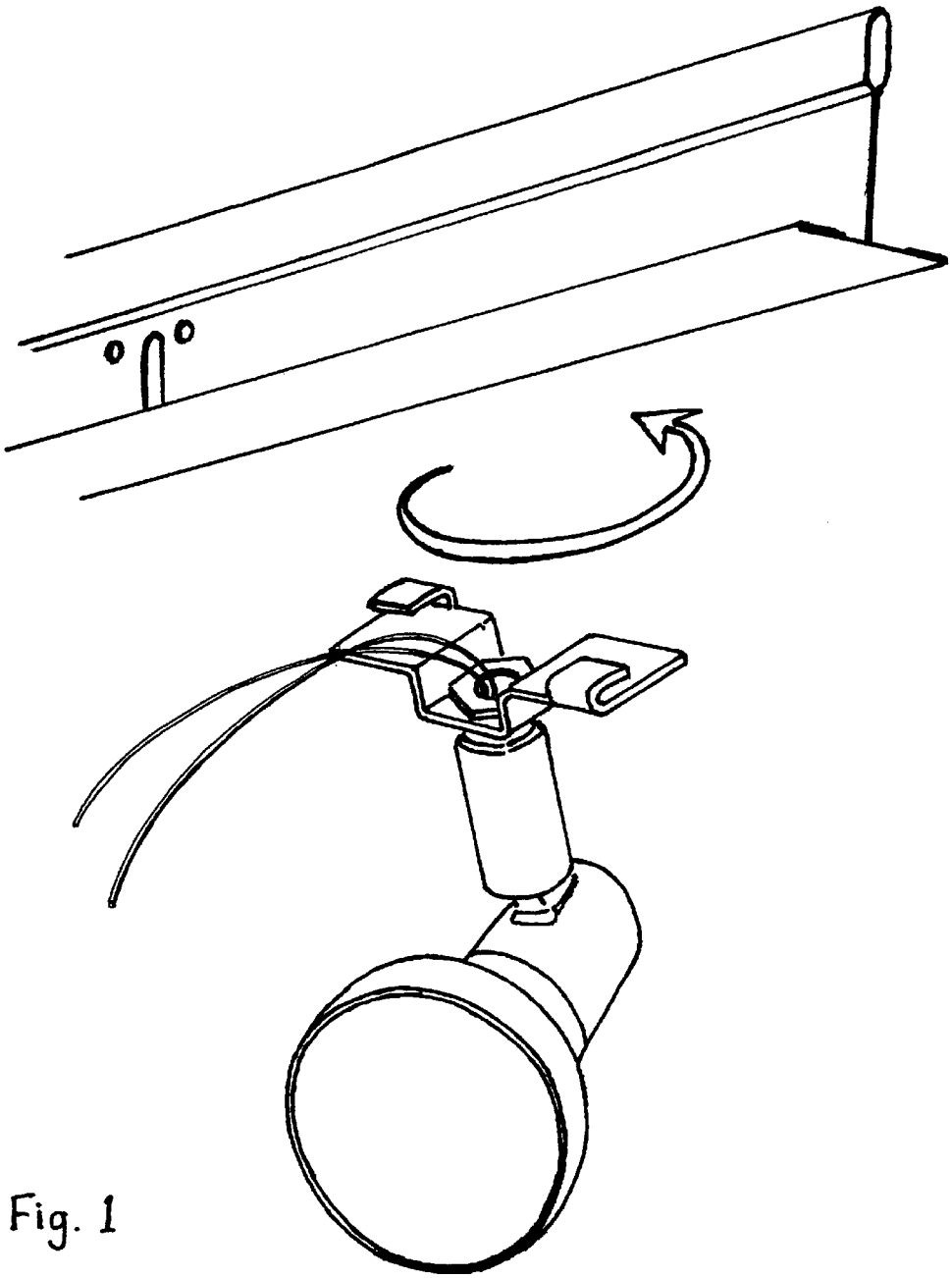
FIG. 1 is a perspective view of a lamp fitting in accordance with the invention.

In FIG. 1 a 12-volt halogen spotlight 1 is pivotably attached by way of a stem 3 to a base 5. The stem is hollow and allows the passage of two PTFE-coated wires 11 to the lamp from the region of the base.

The lamp is to be fitted to a suspended ceiling which is built on the usual grid-like plan of main-tee pieces or tracks 50, each of which has a cross-section in the form of an inverted T. The bar of the T, which is the part that is visible to the occupant of the room in which the ceiling is fitted, forms two opposing flanges 52.

The base 5 of the lamp has the shape of a flanged channel, the channel part forming a central recess into which the two wires 11 emerge from the stem and the outer flanges 7 forming the base proper which is to rest on the T of the ceiling grid. Each flange 7 has a fastening or engagement portion 9 in the shape of a U-section clip or bracket, adapted to hold the base on a flat member, here the T-flange. The base has a generally rectangular shape in plan, the width corresponding to the width of the flange of the ceiling grid.

In this embodiment the fastening portions 9 are on diagonally opposite sides of the base. Fixing of the lamp is therefore as follows: the lamp is applied to the grid member 50 from below in a skew orientation, that is, with the line of the two flanges 7 oblique to that of the grid member. The base is then turned in the direction shown by the arrow, until the clip portions 9 engage the respective sides of the T-flange 52 of the grid.

Once the lamp is fixed to the grid 50, as shown in FIG. 2, the wires 11, which emerge from one end of the channel, can be pressed against the contour of the grid. In this embodiment the wires are commonly available seven-strand PTFE-coated silver-plated copper cables of 0.95 mm diameter and a 6A rating. The wire is in fact slightly thinner than the clip itself. The wires can withstand temperatures up to 250° C., so that there is no problem in running at the relatively high currents required by 12 V lamps. The ceiling panels are, of course, fire-resistant.

Conventional wires such as silicone-coated wires are fragile and are therefore made fairly thick to give them the required strength; this means that they cannot be bent round the tight curve of the cross-section of the T, and even if they were they would interfere with the placing of the panel. PTFE-insulated wires have been used before for lamps, but they are much more expensive than silicone and hence tend to be used only where considerations of temperature dictate. Moreover they are generally several millimeters in diameter, being only required to be thin enough to pass through the stem. They have never been passed, and are too thick conveniently to pass, between a panel and the ceiling grid.

Figure 6:
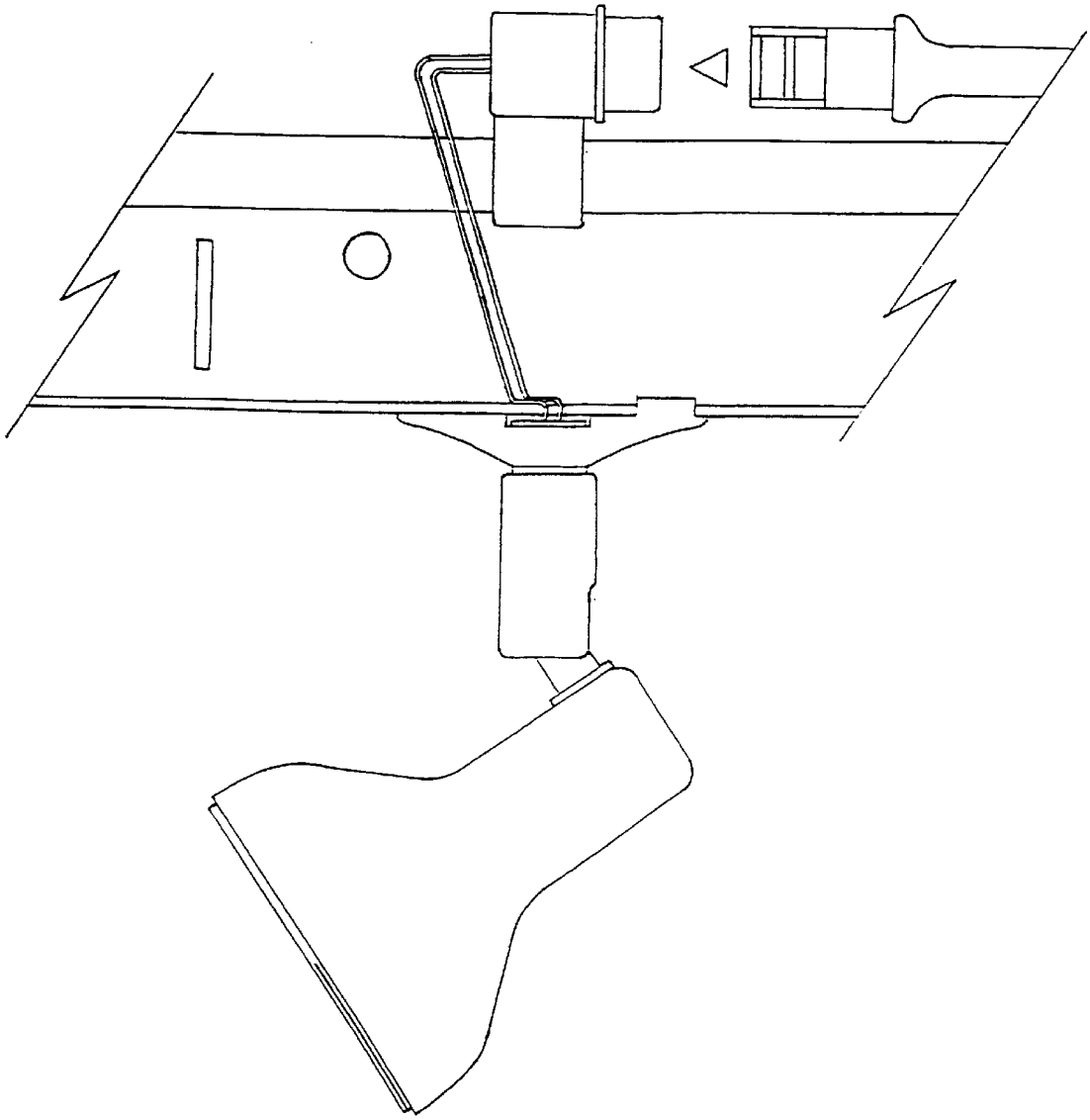

The wires can be perhaps 8–10 cm long, long enough to clear the ceiling assembly. In practice they would lead to a connector from which conventional PVC-coated wires of perhaps 2 m length would lead, such wires being cheaper than the PTFE wire. Such a connector is shown at 20 in FIG. 6, the wires 11 being attached to one connector half 21 seated on the stem of the tee, the other connector half 22 leading to a transformer.

Since the width of the base 5 is the same as that of the T of the grid, namely 15 or 24 mm in standard versions, and since the wires are so thin, the fitting described is very inconspicuous and offers a neat yet inexpensive way of fixing the lamp to the ceiling without any modification of the panels or drilling into the grid. Moreover the panels are not disturbed by the thin wires passing between them and the grid.

Figure 5:
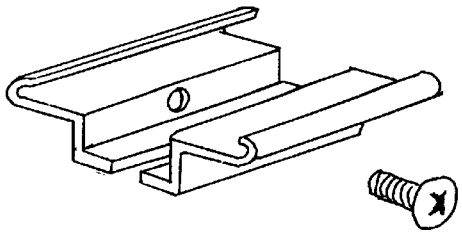

The lamp can be fixed to the grid in many different ways within the scope of this invention. For instance, the base can be of metal or of plastics such as nylon, the latter being easier to fit and less likely to scratch the ceiling grid. Glass-reinforced nylon is particularly preferred. Fastening can be by means of a laterally moving clip such as the embodiment already described or alternatives such as is shown in FIG. 3 with more than one moving part, or versions which clip on to only one side of the T; or even by a spring clip such as shown by way of example in FIG. 4 or by a two-part screwed clamp as shown in FIG. 5. In all cases the thickness of the clip and the wire is about 1 mm, which is within the tolerance of the fitting of the panel.

Figure 7:
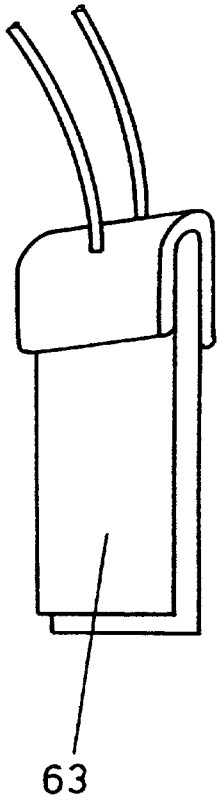
FIGS. 7 and 8 show an alternative wiring construction.
Figure 8:
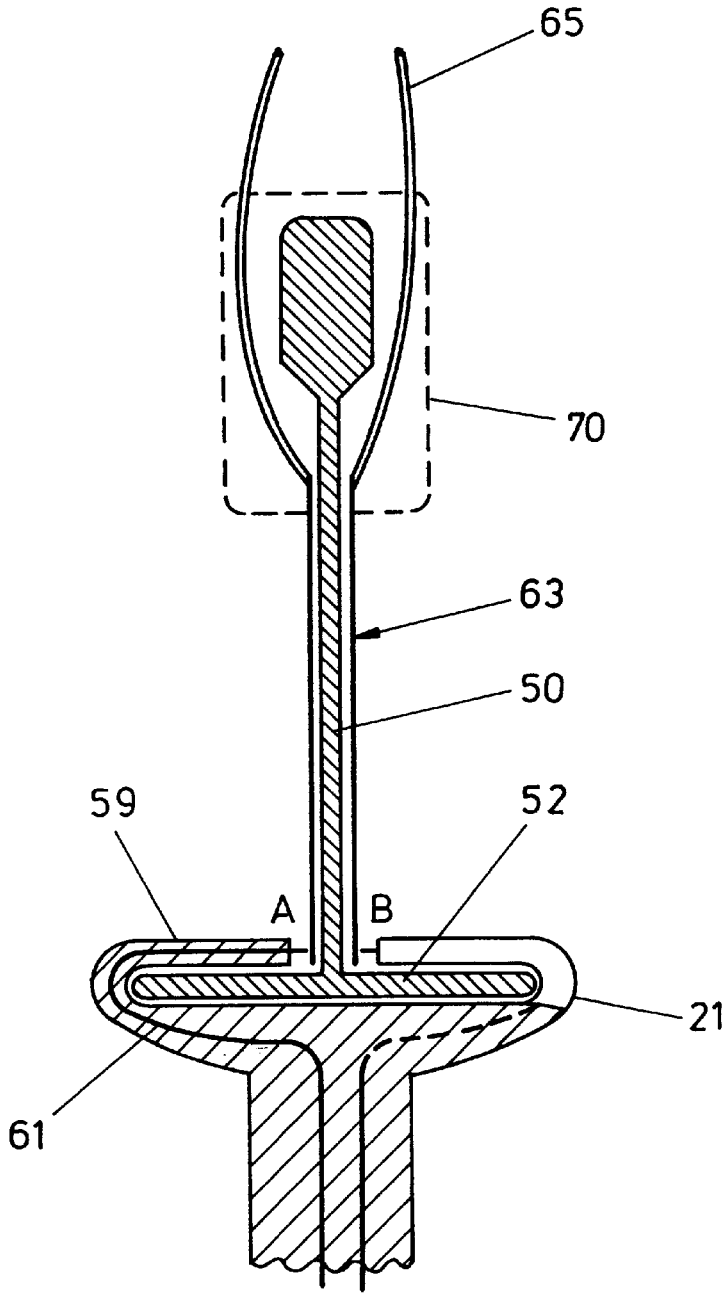

A further modification is shown in FIG. 7, in which integral connectors are used in place of free-standing wires. In FIG. 8 a grid member 50 of a suspended ceiling grid is shown in section, having as before an inverted-T shape. A lamp or similar electrical appliance is suspended from the flange 52 of the T by an attachment member or clip 21, the upper part of which is shown. This clip is made of plastics and can be of any of the designs shown in the earlier embodiments, for instance, it being here assumed that the design of the clip is that of FIG. 1, the "twist-on" variety.

Each engaging portion 59 of the clip carries one strip-shaped section of conducting material 61, on the respective sides A and B of the T. This conducting material protrudes slightly from the end of the engaging portion, that is to say facing the central web of the T 50. These embedded conductors constitute one half of the lamp connector. The lower ends of the strip-shaped conductors emerge, in a manner not shown in the drawing, to form or make contact with the lamp contacts.

The other half of the connector is formed by a pair of conductive sheets 63, again one on each side of the web and extending down to the T-bar. The lamp clip 21, or the conductive strips 61, or the conductive sheets 63 can be resilient or spring-loaded in order to urge the exposed ends of the moulded conductors 61 against the exposed faces of the sheets 63, thus establishing contact, or one can rely simply on the frictional force holding the clip in position. The rear faces of the sheets are insulated to avoid electrical contact with the normally metal grid 50. Wires 65 are led away from the upper part of the sheets 63 to a transformer.

To prevent sliding along the grid member the sheets 63, perhaps a centimeter or two in width, may be held in place by a clip 70 placed on top of the grid member. Alternatively, as shown in FIG. 8, the sheets themselves may be pre-assembled with a resilient clip in the form of an inverted U which can be placed over the grid member 50.

Clearly the connector sheets 63 need not be exposed over their entire outer surface, as long as enough is exposed near the lower end where the clip 21 engages on the T member.

Because the invention fixes the appliance to the ceiling grid by a non-destructive manner, involving frictional engagement or clamping around the outside of the ceiling grid, in the first place the appliance can be fitted at will anywhere on the grid, and in the second place no drilling or intermediate fittings are needed; this is both convenient and preserving of the fabric of the ceiling.

The invention has been described in terms of electrical appliances but clearly the clip type of attachment could be used for other objects to be suspended from a ceiling.

What is claimed is:

1. An electrical appliance for use with a suspended ceiling comprising a ceiling grid and panels mounted on the grid, wherein the appliance includes a base having a central recess with a central aperture, the base adapted to clip onto a member of the suspended ceiling grid, and wiring, passing through the central recess and the central aperture, for connection to an electrical supply above the ceiling.

2. An electrical appliance according to claim 1, in which the base comprises a single clip including two U-section clip portions adapted to engage a rail-shaped flange of the grid member from opposite sides.

3. An electrical appliance according to claim 2, in which the clip portions are adapted to engage the grid by rotation about an axis perpendicular to the grid.

4. An electrical appliance according to claim 1, in which the wiring is stranded silver-plated copper cable coated with an insulator of PTFE.

5. An electrical appliance according to claim 1, in which the appliance is a spotlight adapted to work from a low-voltage supply.

6. A suspended ceiling grid comprising:

a plurality of tracks arranged to form the grid; and at least one electrical appliance, clipped to a track;

wherein the appliance includes a base having a central recess with a central aperture, the base adapted to clip onto a member of the suspended ceiling grid, and wiring, passing through the central recess and the central aperture, for connection to an electrical supply above the ceiling, the wiring being sufficiently thin to pass through the ceiling between the grid and the panels.

7. A suspended ceiling assembly including a grid and panels arranged in the grid, further including an electrical appliance including a base having a central recess with a central aperture, the base adapted to clip onto a grid member and fitted below the panels, wiring passing through the central recess and the central aperture and between the panels and the grid into the space above the panels.

8. An electrical appliance for use with a suspended ceiling having a ceiling grid with flanges and a plurality of panels seated on the flanges, the appliance comprising:

a lamp;

a base attached to the lamp, the base having a central recess with a central aperture, the base including at least one U-section clip, the clip defining an aperture sized to engage a flange; and at least one wire electrically coupled to the lamp; wherein the wire passes through the central recess and the central aperture, and has a thickness that is substantially smaller than the thickness of a panel.

9. An electrical appliance according to claim 8, wherein the thickness of the wire is approximately 1 mm.

10. An electrical appliance according to claim 8, wherein the wire is a flexible cable.

11. An electrical appliance according to claim 10, wherein the wire is a stranded copper cable.

12. An electrical appliance according to claim 10, wherein the wire is a stranded silver-plated copper cable.

13. An electrical appliance according to claim 8, wherein the wire is a PTFE insulated wire.

14. An electrical appliance according to claim 8, wherein the U-section clip has an engagement portion having a thickness that is substantially smaller than the thickness of a panel.

15. An electrical appliance according to claim 14, in which the at least one U-section clip comprises a single clip including two engagement portions adapted to engage a flange from opposite sides.

16. An electrical appliance according to claim 15, in which the engagement portions are adapted to engage a flange by rotation about an axis perpendicular to the grid.

17. An electrical appliance according to claim 14, wherein the thickness of the wire is approximately equal to the thickness of the engagement portions.

18. An electrical appliance according to claim 8, wherein the base includes two U-section clip portions defining two coplanar apertures.

19. An electrical appliance according to claim 8, wherein the lamp is a halogen spotlight.

20. An electrical appliance according to claim 19, wherein the lamp is a low-voltage DC halogen spotlight.

21. A suspended ceiling grid system comprising:

a plurality of tracks arranged to form a grid, each track having a central web and at least one horizontal flange defining an inverted T-section, the tracks defining a plurality of spaces for accepting panels;

a plurality of panels, each panel fitted in a space defined by surrounding tracks and seated on flanges surrounding the space, whereby a portion of the bottom face of the panel and the peripheral edge of the panel define, with the top faces of the supporting flanges and the facing faces of the webs of the surrounding tracks, a peripheral L-shaped gap around the peripheral edge of the panel between the panel and its supporting tracks;

at least one electrical appliance including a base having a central recess with a central aperture, the appliance located below the grid and clipped to the track; and a wire, for electrically connecting the appliance to an electrical supply above the ceiling grid, the wire passing through the central recess and the central aperture.

22. A suspended ceiling grid system according to claim 21, wherein the thickness of the wire is substantially smaller than the thickness of a panel.

23. A suspended ceiling grid system according to claim 21, wherein the wire is sufficently thin and flexible to pass through the L-shpaed gap without substantially displacing the panel.

24. An electrical appliance for use with a suspended ceiling having a ceiling grid with opposing flanges, and having panels seated on the opposing flanges, the electrical appliance comprising:

a base having the shape of a flanged channel, the flanged channel defining outer flanges, the outer flanges adapted to clip onto the opposing flanges of the ceiling grid, the flanged channel further defining a central recess with a central aperture;

a hollow stem attached to the base at the central aperture; and a lamp attached to the hollow stem;

such that the hollow stem and the central aperture form a conduit for passage of at least one electrical wire from the lamp, through the hollow stem, through the central aperture, and into the central recess.

25. A suspended ceiling grid system comprising:

a plurality of tracks arranged to form a grid, each track having a central web and at least one horizontal flange defining an inverted T-section, the tracks defining a plurality of spaces for accepting panels;

a plurality of panels, each panel fitted in a space defined by surrounding tracks and seated on flanges surrounding the space, whereby a portion of the bottom face of the panel and the peripheral edge of the panel define, with the top faces of the supporting flanges and the facing faces of the webs of the surrounding tracks, a peripheral L-shaped gap around the peripheral edge of the panel between the panel and its supporting tracks; and at least one electrical appliance including a base in the shape of a flanged channel defining a central recess with a central aperture, the appliance located below the grid and clipped to the track;

such that the central aperture and the central recess form a conduit for passage of at least one electrical wire from the electrical appliance through the central aperture, through the central recess, and through the L-shaped gap to an electrical supply above the ceiling grid.

26. A suspended ceiling grid system according to claim 25, wherein the wire is sufficiently thin and flexible to pass through the L-shaped gap without substantially displacing the panel.

* * * * *